United States Patent [19]

Berliner et al.

[11] Patent Number: 4,854,911

[45] Date of Patent: Aug. 8, 1989

[54] DOLL WITH WATERPROOF JOINTS

[75] Inventors: William Berliner, Essex; Walter Koda, Newtown, both of Conn.

[73] Assignee: Coleco Industries, Inc., Avon, Conn.

[21] Appl. No.: 150,225

[22] Filed: Jan. 29, 1988

[51] Int. Cl.[4] ..... A63H 3/46; A63H 3/36

[52] U.S. Cl. ..... 446/376; 446/384; 446/390

[58] Field of Search ..... 446/384, 226, 153, 156, 446/223, 220, 376, 379, 381, 382, 383, 375, 390

[56] References Cited

U.S. PATENT DOCUMENTS

| | | | |
|---|---|---|---|
| 1,399,855 | 12/1921 | Fierlein | 446/325 |
| 2,503,948 | 4/1950 | Henry | 446/226 |
| 2,535,116 | 12/1950 | Beebe | 446/379 |
| 2,731,768 | 1/1956 | Harrowe | 446/226 |
| 3,052,061 | 9/1962 | Beebe | 446/384 |
| 3,065,566 | 11/1962 | Sugimoto | 446/221 |
| 3,699,715 | 10/1972 | Lewis et al. | 446/376 |
| 3,816,957 | 6/1974 | Nakajima | 446/379 |
| 3,818,631 | 6/1974 | Cederholm | 446/371 |
| 3,881,276 | 5/1975 | Kosicki et al. | 446/383 |
| 3,940,880 | 3/1976 | Kaelin et al. | 446/381 |
| 4,055,020 | 10/1977 | Kosicki et al. | 446/226 |
| 4,526,553 | 7/1985 | Guerro | 446/382 X |
| 4,536,165 | 8/1985 | Maar | 446/153 |
| 4,568,298 | 2/1986 | Acree | 446/74 |

FOREIGN PATENT DOCUMENTS

| | | | |
|---|---|---|---|
| 744506 | 10/1966 | Canada | 446/375 |
| 2504737 | 2/1975 | Fed. Rep. of Germany | 446/384 |
| 1337081 | 7/1963 | France | 446/226 |
| 2534822 | 4/1983 | France | 446/376 |
| 1049940 | 11/1966 | United Kingdom | 446/226 |
| 2035103 | 6/1980 | United Kingdom | 446/376 |

*Primary Examiner*—Robert A. Hafer
*Assistant Examiner*—D. Neal Muir

[57] ABSTRACT

A toy figure comprising a hollow body or torso member has at least one extremity receiving socket disposed therewithin having an annular sidewall and a base wall and formed integrally with the body member. The hollow extremities have a projecting socket with an annular sidewall and a base wall which has a depending boss extending into the cavity of the extremity, and a passage extends therethrough. A plug member is seated in the socket and it has a depending finger sealing the passage through the base wal of the socket. A connector engages the outer surface of the socket of the extremity and the inner surface of the socket of the torso to provide a rotatable connection between them. Expanding air pressure in the extremity cavity causes the material of the depending boss to clamp the finger tightly to seal the passage and hold the plug in assembly.

7 Claims, 3 Drawing Sheets

DOLL WITH WATERPROOF JOINTS

FIELD OF THE INVENTION

This invention relates to toy figures, dolls and the like and, more particularly, relates to a toy figure with a novel joint construction which may be submerged in water without passing of water into, or loss of air pressure from the interior of the portions of the structure which employ the novel joints.

BACKGROUND OF THE INVENTION

A child will often wish to have a doll accompany it into the bathtub, or into other water environments. If the doll has movable limbs, the joints may permit water to pass into the interior structure unless there is a waterproof joint between the limbs and the torso. Moreover, frequently the joint will also allow air to escape from the interior unless it is air-tight. Thereafter, the water may leak from the doll in an undesirable place such as when the doll is in bed with the child, and/or the entire torso, and/or the limbs may collapse from loss of internal air pressure.

Dolls with movable limbs are generally preferred by the user to effect a semblance of being lifelike, that is, having rotatable or otherwise movable limbs. Moreover, today dolls are generally molded from plastic, and the molding operation or the intended doll structure may require that the limb and torso be hollow and pliable. Therefore, the joints of the limbs to the torso are desirably constructed so that water will not enter the hollow torso and limbs and so that internal air pressure will not be lost through the joints.

This problem has previously been addressed in a number of ways. In U.S. Pat. No. 4,526,553 spade-like members are molded integrally with the torso and extend into receptacles therefor on the limbs. However, this construction does not provide free pivoting of the limbs with respect to the torso.

U.S. Pat. No. 3,816,957 also addresses this problem and utilizes a plurality of connecting members to effect a water-tight seal between the hollow torso and limbs of the doll. U.S. Pat. No. 4,536,165 discloses limb-to-torso connections which are intended to provide a water-tight seal between the torso and the limbs by a specially formed water-tight seal; however, pivotal movement of a limb with respect to the torso may cause such seals to leak water into either or both the torso or limbs.

It has also been suggested to seal the extremities of a doll by adhering a plug or cap into the opening of an extremity: however, such a plug or cap may be popped out due to increased air pressure within the extremity due to squeezing of the extremity, or heating of the contained air, or both.

Accordingly, it is an object of the present invention to provide a new, improved and simplified doll construction in which the extremities are joined to the torso by a novel fluid and air-tight joint which permits pivotal movement while preventing entrance of water into the cavities and loss of air therefrom due to any increase in air pressure within the cavity.

Another object is to provide such a doll construction with a water and air-tight joint which may be effected readily and relatively economically.

SUMMARY OF THE INVENTION

It has now been found that the foregoing and related objects and advantages may be readily attained in a toy figure which has a hollow torso member with portions for receiving simulated arms, legs and head. Hollow extremity members simulating arms and legs, are coupled thereto and at least one of the portions of the torso for receiving one of the extremity members has an integrally formed, inwardly extending socket with an cylindrical side wall and a base wall providing an outwardly opening recess. The adjacent end of the cooperating extremity member has an integrally formed, socket extending outwardly therefrom with an annular sidewall and a base wall defining an outwardly opening recess. The extremity socket extends into the recess of the torso socket, and the base wall of the extremity socket has a depending boss centrally thereof which is disposed within the hollow cavity provided by the extremity member. A passage extends through the base of the base wall and into the extremity.

A plug member is snugly seated in the recess of the extremity member socket and has a depending pin portion seated in the passage through the base wall and boss. As a result, air pressure in the cavity of the extremity member causes the boss to clamp the pin portion and hold it securely therewithin. A connecting member is engaged with the extremity member socket and has its outer periphery engaged with the torso socket to retain the members in assembly for relative rotation.

In the preferred embodiments, the doll extremities are fabricated from a resiliently deformable resin and the boss of the extremity member socket is compressible by air pressure in the cavity of the extremity member against the pin portion. The boss is of annular cross section and has its outside wall tapering to a reduced diameter at its lower end. The plug member has a generally cup-shaped body portion, and is adhered to the extremity member socket.

Desirably, the extremity member socket sidewall has an outwardly extending flange about its periphery and the connecting member has a flange extending outwardly about its periphery at one end thereof engaged with the flange of the extremity member socket. The torso socket sidewall has a groove extending about its inner periphery and the connecting member rotatably seats in the groove.

DESCRIPTION OF THE PREFERRED EMBODIMENT OF THE INVENTION

Figure 1:
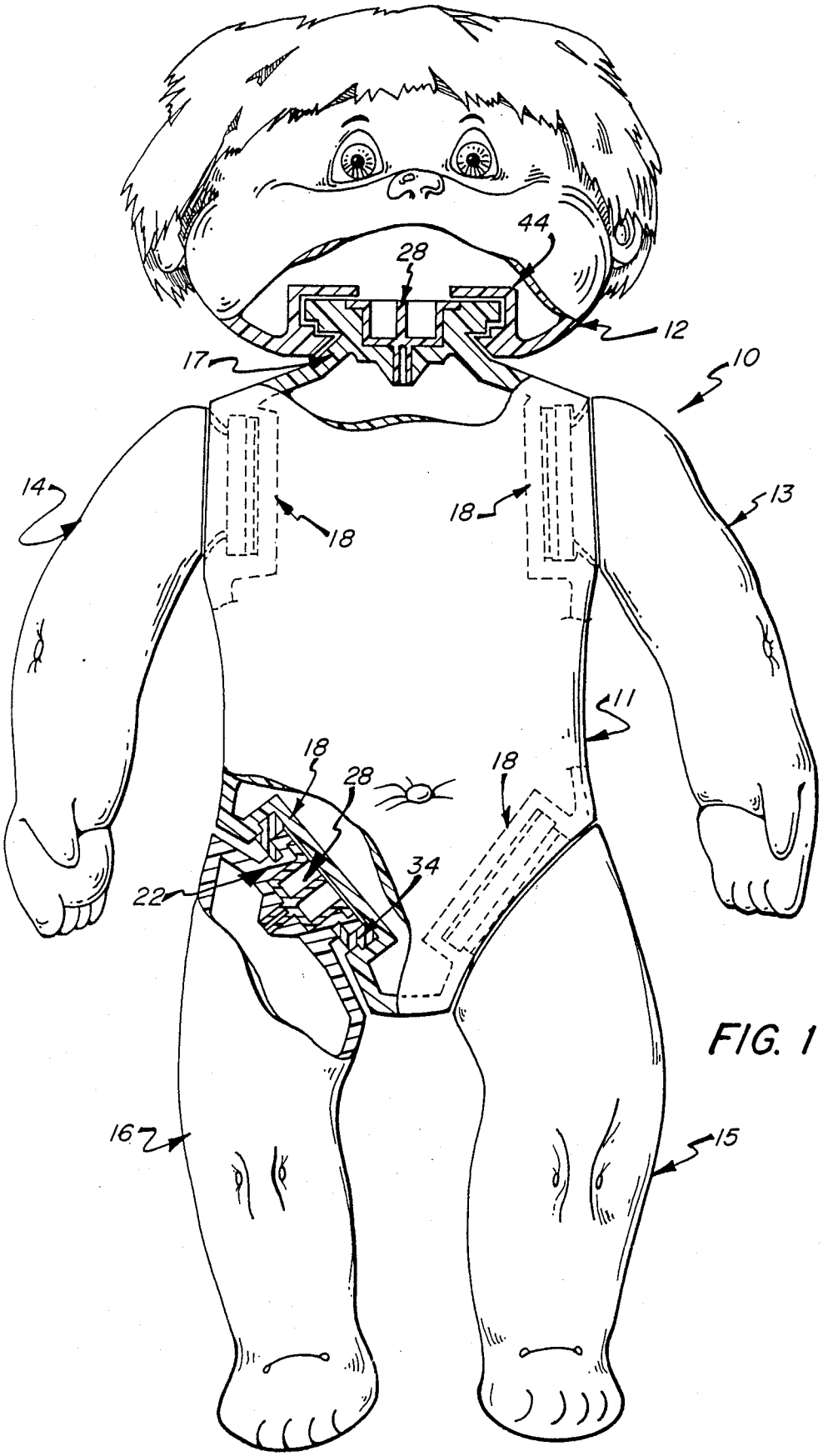
FIG. 1 is a front elevational view of a doll embodying the invention with portions broken away to reveal internal construction.

Turning first to FIG. 1, a doll embodying the present invention is generally designated by the numeral 10 and has a hollow body or torso generally designated by the numeral 11, a hollow head generally designated by the numeral 12, hollow arm extremities generally designated by the numerals 13 and 14, and hollow leg extremities generally designated by the numerals 15 and 16. The head, legs and arms are all provided with rotatable joints as will be described more fully hereinafter, and are molded from a resiliently deformable resin providing a soft "feel", such as polyvinyl chloride, by rotational molding.

As seen in FIG. 1, the torso 11 has integrally molded thereinto sockets generally designated by the numeral 18 which are disposed therewithin and which receive the arms 13, 14 and legs 15, 16. The torso 11 also has an outwardly projecting socket generally designated by the numeral 17 and which seats in the head 12.

As seen in the drawings, the socket 18 extends inwardly of the cavity provided by the hollow torso 11 and is defined by a generally cylindrical sidewall 19 and a planar base wall 20. The inner periphery of the sidewall 19 has a recessed portion or groove 21 extending thereabout adjacent the base wall 20.

Figure 3:
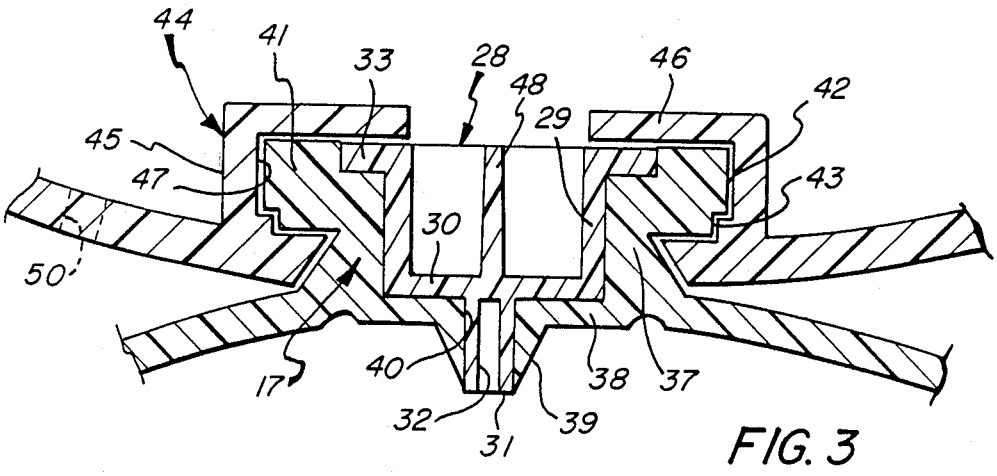
FIGS. 3 is a sectional view of the joint between head and torso of FIG. 1 drawn to an enlarged scale.
Figure 2:
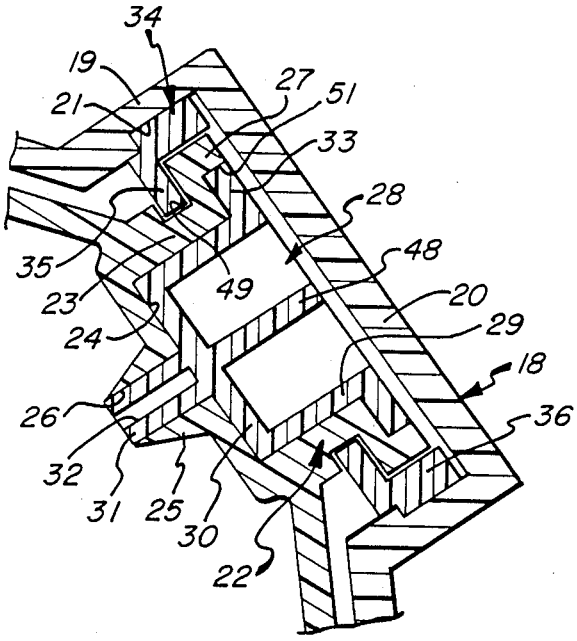
FIG. 2 is a sectional view of a joint for a leg in the doll of FIG. 1 drawn to an enlarged scale.
Figure 4:
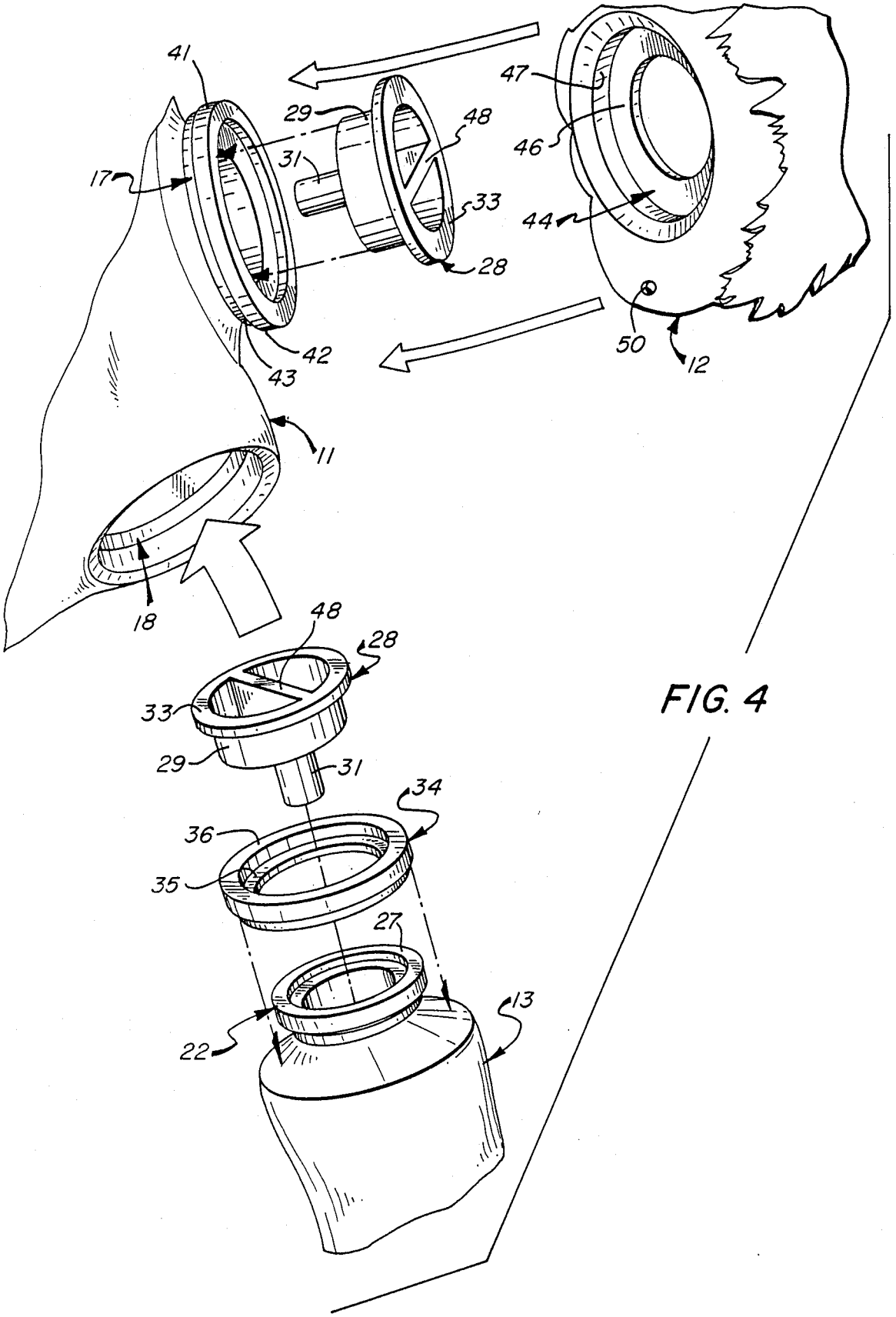
FIG. 4 is an exploded fragmentary perspective view of portions of the head and shoulder of the doll of FIG. 1 drawn to an enlarged scale and showing the connections of the torso to the head and an arm.

As best seen in FIGS. 2 and 3, the extremities 13–16 are provided with sockets generally designated by the numeral 22, and which project outwardly from the ends thereof to seat in the sockets 18. Each of the sockets 22 has a generally cylindrical sidewall 23 and a base wall 24 with a centrally disposed, depending boss 25. A passage 26 of circular cross section extends through the base wall 24 and its boss 25. The outer end of the sidewall 23 has a flange 27 extending about its outer periphery and a groove 49 extending about its outer periphery therebelow. The sidewall 23 also has an annular recess 51 extending about its inner periphery.

Seated in the socket 22 is a plug generally designated by the numeral 28 having a cup-shaped body portion defined by a generally annular sidewall 29 and base wall 30. A pin 31 of circular cross section depends from the base wall 30 and extends within the passage 26, and it has a central bore 32 extending from its free end partially therethrough. To facilitate insertion and rotation of the plug 28 in the socket 22, a rib 48 extends diametrically across the open end of the plug to facilitate gripping and rotation. About the outer end of the sidewall 29 is a flange 33 which extends about its outer periphery and seats in the recess 51 of the sidewall 23.

To retain the sockets 18 and 22 in assembly, a connector ring generally designated by the numeral 34 couples the two components. The ring 34 has an inwardly extending flange 35 about the inner periphery which engages under the flange 27 on the outer end of the socket 22, and it has a collar 36 extending about its outer periphery which seats in the groove 21 of the socket 18.

If so desired, the base wall 30 of the plug 28 may be adhesively bonded to the base wall 24 of the socket 22.

The collar 36 of the connector ring 34 may be adhesively bonded in the groove 21, or secured against rotation therein solely by friction. The clearance between the flange 35 and the flange 27 permits facile rotation between the extremity 16 and the torso 11.

Turning now to FIG. 3, the joint construction for the neck is therein illustrated. In this instance, the torso 11 is formed with an outwardly projecting socket 17 with a sidewall 37 of circular cross section and a base wall 38 having a depending boss 39 extending into the cavity of the torso 11. A passage 40 extends through the base wall 38 and boss 39, as in the instance of the arm and leg joints. Extending outwardly about the outer end of the sidewall 37 is a stepped flange 41 with a wall of reduced diameter portion 37 poviding a larger diameter collar 42 and a narrower diameter shoulder 43.

The head 12 is formed with an inwardly extending socket generally designated by the numeral 44 with a sidewall 45 of circular cross section and a partial, annular base wall 46. The inner periphery of the sidewall 45 has a groove 47 extending thereabout which seats the larger diameter collar 42 of the flange 41 to provide a rotatable connection between the head 12 and torso 11. A plug 28 is seated in the socket 17 to seal the torso 11.

It will be appreciated that the plugs effectively seal one half of the joints in which they are disposed. Although adhesive or solvent bonding of the base wall of the plug to the base wall of the socket is desirably employed to improve sealing action, the plug is molded from a more rigid resin then that of the socket and it is dimensioned to form a friction seal with the sidewall of the socket and its pin similarly makes a friction seal with the wall of the passage in the boss. For this reason, insertion of the plug requires some stitching and relative rotation.

The area at the end of the pin is relatively small compared to the length in such sealing engagement. As a result, when air pressure builds up within the hollow member due to heating or due to flexure inwardly of the member, the pressure acts upon the outer periphery of the boss which is formed from relatively resilient resin and this increases the clamping pressure, thus preventing air loss or water passage through the joint.

It will be appreciated that the opening to the head provided by the head socket is not shown as sealed. If the doll head has openings therethrough such as required by simulated hair rooted through openings in the wall, water will enter therethrough. Therefore, it is desirable to provide a drain hole 50.

Thus, it can be seen that the doll of the present invention has a highly effective rotational joint which will effectively preclude water entry and air loss. The joint components may be fabricated economically and assembled readily and quickly.

Having thus described the invention, what is claimed is:

1. A toy figure comprising:

(a) a hollow torso member with portions for receiving simulated arms, legs and head;

(b) hollow extremity members simulating arms and legs, at least one of said portions of said torso having an integrally formed, inwardly extending socket with a cylindrical sidewall and a base wall providing an outwardly opening recess, an end of a cooperating extremity member having an integrally formed socket extending outwardly therefrom with a cylindrical sidewall and a base wall defining an outwardly opening recess, said outwardly extending extremity socket extending into said recess of said inwardly extending torso socket, said base wall of said extremity socket having a depending boss centrally thereof disposed within the hollow cavity defined within the extremity member, said base wall and boss portion of said extremity socket having a passage extending therethrough ;

(c) a plug member snugly seated in said recess of said extremity member socket and having a depending pin portion seated in said passage through said base wall and boss portion of said extremity socket, whereby air pressure in said cavity of said extremity member causes said boss portion to clamp said pin portion said plug member having a flange which supports said extremity socket sidewall in its cooperation with said torso socket sidewall to limit extremity socket deformation and (d) a connecting member extending about and engaged with said extremity member socket, the outer periphery of said connecting member being engaged with said torso socket to retain said members in assembly and permitting relative rotation between said sockets.

2. The doll in accordance with claim 1 wherein said doll extremities are fabricated from a resiliently deformable resin and the boss portion of said extremity member socket is compressible by air pressure in the cavity of said extremity member against said pin portion.

3. The doll in accordance with claim 1 wherein said boss portion is generally conical and has its conical wall tapering to a reduced diameter at its end spaced from said base wall of said extremity socket.

4. The doll in accordance with claim 1 wherein said plug member has a generally cup-shaped body portion.

5. The doll in accordance with claim 1 wherein said plug is adhered to said extremity member socket portion.

6. The doll in accordance with claim 1 wherein said sidewall of said extremity member socket has a radially outwardly extending flange about its periphery and said connecting member has a flange extending radially inwardly about its periphery at one end thereof engaged with said flange of said extremity member socket.

7. The doll in accordance with claim 6 wherein said sidewall of said torso socket has a groove extending about its inner periphery and said connecting member seats in said groove.

* * * * *